US012680408B2

(12) United States Patent
Fairweather et al.

(10) Patent No.: US 12,680,408 B2
(45) Date of Patent: Jul. 14, 2026

(54) METHODS AND APPARATUS FOR CASING RECOVERY

(71) Applicant: Ardyne Holdings Limited, Aberdeen (GB)

(72) Inventors: Alan Fairweather, Aberdeen (GB); David Stewart, Aberdeen (GB); James Linklater, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 19/098,061

(22) Filed: Apr. 2, 2025

(65) Prior Publication Data

US 2025/0230723 A1 Jul. 17, 2025

Related U.S. Application Data

(62) Division of application No. 18/571,225, filed as application No. PCT/EP2022/069719 on Jul. 14, 2022, now Pat. No. 12,338,701.

(30) Foreign Application Priority Data

| | | |
|---|---|---|
| Jul. 15, 2021 | (GB) | 2110205 |
| Mar. 16, 2022 | (GB) | 2203629 |
| Jun. 9, 2022 | (GB) | 2208461 |

(51) Int. Cl.
*E21B 31/16* (2006.01)
*E21B 31/00* (2006.01)
(Continued)

(52) U.S. Cl.
CPC ..... *E21B 31/16* (2013.01); *E21B 31/005* (2013.01); *E21B 31/20* (2013.01); *E21B 43/11* (2013.01)

(58) Field of Classification Search
CPC ..... E21B 31/20; E21B 31/005; E21B 29/002; E21B 43/11; E21B 31/16; E21B 31/03
See application file for complete search history.

(56) References Cited

U.S. PATENT DOCUMENTS

| | | | | |
|---|---|---|---|---|
| 12,338,701 | B2 | 6/2025 | Fairweather et al. | |
| 2014/0251616 | A1* | 9/2014 | O'Rourke ..... | E21B 33/1208 166/55.7 |

(Continued)

FOREIGN PATENT DOCUMENTS

| | | | |
|---|---|---|---|
| GB | 2473527 | A | 3/2011 |
| GB | 2549523 | A | 10/2017 |

(Continued)

OTHER PUBLICATIONS

Intellectual Property Office of the UK Patent Office; Search Report for GB2210322.0; Nov. 14, 2022; one page; Intellectual Property Office of the UK Patent Office, Newport, South Wales, United Kingdom.

(Continued)

*Primary Examiner* — Yong-Suk (Philip) Ro
(74) *Attorney, Agent, or Firm* — LAW OFFICE OF JESSE D. LAMBERT, & LLC

(57) ABSTRACT

Method of removing casing from a well, in which an annulus between the outside of the casing and the inside of a surrounding downhole body is at least partially filled by debris, the perforated section of casing is washed in casing lengths shorter than the perforation length and an attempt made to pull the casing after each shorter length is washed. If the casing is free after washing only a shorter section of the perforated section of casing then it can be recovered and saves the washing time. A bottom hole assembly is described which includes a downhole power tool to exert a greater force to pull the section of casing between washing steps.

7 Claims, 4 Drawing Sheets

(51) Int. Cl.
*E21B 31/20* (2006.01)
*E21B 43/11* (2006.01)

(56) References Cited

U.S. PATENT DOCUMENTS

| | | | | |
|---|---|---|---|---|
| 2015/0047845 | A1 | 2/2015 | Larsen et al. | |
| 2016/0130901 | A1* | 5/2016 | Coronado | E21B 34/12 166/298 |
| 2019/0162033 | A1* | 5/2019 | Engevik | E21B 37/02 |
| 2019/0162046 | A1* | 5/2019 | Engevik | E21B 34/06 |
| 2020/0072009 | A1 | 3/2020 | Fairweather | |
| 2021/0355778 | A1* | 11/2021 | Kristiansen | E21B 31/20 |

FOREIGN PATENT DOCUMENTS

| | | | |
|---|---|---|---|
| GB | 2562088 | A | 11/2018 |
| GB | 2562089 | A | 11/2018 |
| GB | 2562090 | A | 11/2018 |
| GB | 2583015 | A | 10/2020 |
| GB | 2608264 | A | 12/2022 |
| WO | 2015105427 | A2 | 7/2015 |
| WO | 2020256563 | A1 | 12/2020 |

OTHER PUBLICATIONS

The International Bureau of WIPO, The International Search Report and the Written Opinion of the International Searching Authority for PCT/EP2022/069719; Nov. 21, 2022; seventeen pages; European Patent Office, Rijswijk, The Netherlands.

Intellectual Property Office of the United Kingdom Patent Office; Examination Report for GB2210322.0; Jul. 6, 2023; all pages; Intellectual Property office of the UK Patent Office, South Wales, United Kingdom.

* cited by examiner

METHODS AND APPARATUS FOR CASING RECOVERY

CROSS-REFERENCE TO RELATED APPLICATIONS

This United States non-provisional patent application is a divisional of U.S. non-provisional patent application Ser. No. 18/571,225, filed Dec. 16, 2023, which is an application under 35 USC Sec. 371 of PCT/EP2022/069719, filed Jul. 14, 2022. Foreign priority is claimed to GB2110205.8, filed Jul. 15, 2021; GB2203629.7, filed Mar. 16, 2022; and GB2208461.0, filed Jun. 9, 2022.

BACKGROUND OF THE INVENTION

The present invention relates to methods and apparatus for well abandonment and slot recovery and in particular, to a method and apparatus for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling can be achieved on a single trip.

In the ideal scenario, such tools would cut the casing at a maximum depth, being preferably the desired casing cutting target depth to meet legislative requirements, and then pull the cut section of casing from the well on a single trip. However, the presence of drilling fluid sediments, cement, sand or other debris behind the casing can prevent the casing from being pulled. It may be appreciated that when the casing needs to be cut into very short pieces so that the stuck casing sections can be pulled, the number of casing recovery operations increases, thereby increasing the time and cost of the operation.

US2015047845 to Well Technology AS describes a method of removing casing from a well, in which an annulus between the outside of the casing and the inside of a surrounding downhole body is at least partially filled by a viscous and/or solid mass, the method comprising:

(A) setting a first sealing element into fluid-sealing engagement with the inside of the casing at a first depth in the well;

(B) lowering a string into the well, a cutting tool and a second, reversibly expandable sealing element being connected to the string, and the string being arranged to carry a fluid;

(C) forming perforations into the casing with said cutting tool at a second depth in the well which is smaller than the first depth at which the first sealing element is set into fluid-sealing engagement;

(D) expanding the second, expandable sealing element into fluid-sealing engagement with the inside of the casing a third depth in the well which is smaller than the second depth at which the perforations were formed, so that the perforations will be at a depth in the well between the first and second sealing elements;

(E) passing a fluid at high pressure through the string and into the annulus via the perforations so that the viscous and/or solid mass is displaced up the annulus, circulated out of the well and substantially replaced by the fluid, the fluid having a lower specific weight than the viscous and/or solid mass;

(F) cutting the casing around its entire circumference at a fourth depth, down to which the surrounding viscous and/or solid mass has substantially been replaced by the fluid; and (G) pulling a length of the casing up from the well.

This method advantageously washes out all material in the annulus between the outside of the casing and the inside of a surrounding downhole body, so that the casing is free to be cut and pulled without sticking. However, to ensure that all the viscous and/or solid mass is circulated up the annulus and out of the well, only short sections of casing can be washed, cut and pulled on each trip into the well. The process is thus started near the top of a section of casing, a short length of casing is perforated, washed and pulled, the casing being typically only a few metres in length. Additionally, the time taken to wash out the length of casing can be significant. The short length of casing is brought to surface and further trips are undertaken to perforate, wash, cut and pull subsequent lengths until the full length of the casing section is removed. The total time taken to remove the entire casing section is therefore very long.

A further disadvantage with this method is that the second sealing element, typically a packer, can only be set after the cutting tool has made the perforation. This is because the annulus between the string and casing must remain open in order to circulate fluid through the string and up the annulus to cool the cutting tool and carry swarf and other cutting debris to surface during operation of the cutting tool. Thus the packer, which is needed to direct the fluid for washing into the perforations, can only be set after the cutting tool has made the perforations. A major disadvantage of this is that the well is open during the cutting process and consequently there is no well control in the event a kick occurring.

In order to wash out greater lengths of casing, so that a longer length of casing can be pulled on a single trip, WO2015/105427 discloses a method for pulling out casing pipes or liner in a petroleum well, characterized by the combination of the following steps:

a) perforating an actual section of said casing pipe in said well by means of a perforating gun, said perforating gun mounted on a wash tool further arranged directly or indirectly to a drill pipe string;

b) by means of said wash tool arranged for isolating with gaskets on said tool's own stem isolating against said casing pipe's/liners inner wall above and below said wash tools outlet channel by said perforated section of said casing pipe and for flushing wash fluid out through said perforations, for thereby washing one or more annuli outside the perforated section for removing debris, particles or cement or other binding substance otherwise holding said casing pipe section, c) cutting, by means of a cutting tool the actual section of said casing pipe within or below the perforated section for releasing it from the remaining, deeper residing part of said casing pipe, d) pulling said released, washed-out section of said casing pipe out of said well.

The actual section of casing pipe is a length of casing which is longer than the perforation gun so that casing of lengths of 10 to 100 metres can be perforated along the entire length and circumference. Advantageously the distance between the gaskets on the wash tool is significantly smaller than the perforated casing length and thus wash fluid expelled out through the perforations will return to the annulus between the drill pipe and the casing at locations above the wash tool, to be circulated to surface. The wash fluid will carry debris back into the annulus for return also which is much more efficient than the washing process of US2015047845. However, the washing step involves running up and down the length of perforated casing and can take a significant time.

In both these techniques, the length of casing which can be pulled is limited and thus a desired length of casing will need to be cut and pulled in sections. This takes additional time due to the additional runs required to be made into the well.

In order to cut and pull a desired length of casing in a single trip WO2020/256563 describes a technique in which the casing is perforated near the top of the section to be removed to create a reference circulation hole (P0); the punch tool is then run to an expected "estimated" free casing depth (EFCD), a test circulation hole (P1) is punched and a wash tool used to flow fluid from P1 to P0 with free communication therebetween; moving down the casing, punch further test circulation holes P2, P3 . . . and use the wash tool to test for circulation to P0 at each hole until there is no fluid communication back through P0; assume an actual free casing depth (AFCD) exists between the last punched hole and the preceding punched hole; move the punch tool back to the preceding punched hole and perforate the casing down to the desired casing cutting target depth (CCTD); pull the wash tool out while washing the debris filled annulus until a satisfactory return of flushed out annulus material is achieved; run a casing cutter to the CCTD and cut the casing; engage a casing spear to the cut section of casing; and pull the cut section of casing out of the hole.

This technique reduces the length of casing to be washed and perforated, while allowing the desired casing cutting target depth to be maintained. However, in all the washing steps for the above techniques it will be appreciated that only a proportion of the debris may be removed. Fluid exiting the perforations will find the path of least resistance through the debris and wash clear a channel, but will not clear the entire circumference of the annulus. This is because once a channel has been cleared, further time spent circulating fluid will have less and less effect on debris removal and therefore the casing piece may remain stuck following the washing step.

Additionally, depending on the length of the casing piece to be recovered and on the amount and the compactedness of the debris in the annulus, the washing operation can take many hours. In some cases, a lengthy washing operation can exceed the desired time saving benefits of the technique over cutting and pulling shorter sections.

It is therefore an object of the present invention to provide a method of removing casing from a well which obviates or mitigates one or more disadvantages of the prior art.

It is a further object of the present invention to provide a bottomhole assembly for removing casing from a well which obviates or mitigates one or more disadvantages of the prior art.

SUMMARY OF THE INVENTION

According to a first aspect of the present invention there is provided a method of removing casing from a well, in which an annulus between the outside of the casing and the inside of a surrounding downhole body is at least partially filled by debris, comprising the steps:

(a) determining a casing cutting target depth (CCTD) to provide a section of casing for removal;
(b) cutting the casing at the casing cutting target depth (CCTD);
(c) perforating the section of casing along a perforation length thereof;
(d) washing the annulus along a first length of the section of casing by passing fluid through the perforations, the first length being shorter than the perforation length to clear at least a portion of the debris;
(e) gripping the section of casing;
(f) pulling the section of casing;
(g) in the event that the section of casing is free, pulling the section of casing from the well.

In this way, if the casing is free after washing only a shorter section of the perforated section of casing then it can be recovered and saves the additional washing time of the prior art techniques.

Preferably, the steps are completed in the order presented. Alternatively, step (b) may be performed at any point between steps (a) and (f). Accordingly, step (b) may be performed between steps (c) and (d), or (d) and (e), or (e) and (f).

Preferably, in the event that the section of casing is not free, the method includes selecting a second length of the section of casing and repeating steps (d) to (g) on the second length. The method may then include selecting subsequent lengths of the section of casing until the section of casing is free and can be pulled from the well. By pulling the section of casing periodically during washing, the section of casing can be pulled from the well as soon as it is free. This saves significant time in reducing the amount of washing required.

Preferably the method includes the step of anchoring a downhole power tool to the surrounding downhole body at a position uphole of the cut section of casing and in step (f) pulling is by exerting a force from the downhole power tool on the section of casing. In this way, a greater pulling force than that achievable from a standard casing spear can be used in an attempt to free the casing. The surrounding downhole body will preferably be an outer casing.

Preferably, the perforation length is a majority of the section of casing. Alternatively, the perforation length may be a length between a free casing depth and the CCTD. In this way, the method can be used with the method of WO2020/256563 whose content is incorporated herein by reference.

Preferably, the first and second lengths are sequentially located along the perforation length. Alternatively, the first and second lengths overlap by at least a portion. Preferably, the first, second and subsequent lengths are sequentially located along the perforation length. In this way, the perforation length may entirely be washed. Alternatively, one or more of the first, second and subsequent lengths overlap. This provides a more intense wash over the same length of perforations.

Preferably, steps (e) and (f) can be performed between steps (b) and (c) to see if the cut section of casing can be pulled free without requiring perforation and washing. In this embodiment the downhole power tool will be used to try and pull the casing. Additionally, a circulation test may be performed during or after step (b) to provide an indication of the level of debris in the annulus. By circulating fluid through the cut as it is made, a return at surface can be looked for.

Preferably, in step (c) one or more perforating tools are located on a tool string and run into the well. The perforating tools are operated over the perforation length. This may be performed in sequential steps with a perforating tool length shorter than the perforation length. Optionally, the one or more perforating tools are perforation guns being fired over the perforation length. The method may then include the step of dropping the guns from the tool string after step (c).

Preferably, in step (d) a wash tool is moved along the perforated casing. The wash tool may be moved uphole, downhole or in a pattern in both directions. The wash tool directs fluid into the perforations.

Preferably step (f) includes vibrating the section of casing to assist in freeing the section of casing. The method may also include vibration during step (d) to assist in loosening debris during washing.

Preferably steps (c) to (f) are performed on a single trip into the well. More preferably steps (b) to (f) are performed on a single trip into the well. Steps (d) to (f) may be performed on a single trip in the well. Alternatively, steps (c) to (g), steps (b) to (g) or steps (d) to (g) may be performed on a single trip into the well. Advantageously, the steps relating to the second and subsequent lengths with the repeated steps are performed on a single trip.

In an embodiment, the method is performed in two trips into the well. Preferably the first trip includes step (c) and the second trip includes steps (d) to (g). Step (b) may be performed on either trip. The first trip may include cutting and pulling an upper section of casing so that an inner wall of the downhole surrounding body is exposed for anchoring the downhole power tool. More preferably the first trip includes the step of identifying the free casing depth and cutting and pulling the upper section of casing at around the free casing depth.

In the event that the first and/or second and/or subsequent lengths have been washed and the casing is still not free, the method may include the additional steps of cutting the casing at a shallower depth and pulling the shorter section of casing. In this way, if the section of casing proves unpullable, even after extensive washing, the casing can be cut in the same trip, thereby enabling at least a shorter section of the casing to be recovered.

According to a second aspect of the present invention there is provided a bottom hole assembly (BHA) for recovering a first casing located through a second casing in a well, the second casing having a greater diameter than the first casing, the BHA being mounted on a tool string having a through bore, the BHA comprising:

- a wash tool having at least one port arranged to eject fluid from the throughbore towards the first casing;
- a casing spear configured to grip the first casing; and
- a downhole power tool having an anchor mechanism configured to grip the second casing and a hydraulic driven piston to exert a force on other components of the BHA.

In this way, the first casing can be assisted in being pulled using a downhole power tool, when the first casing is not entirely washed.

Preferably, the wash tool has an upper seal and a lower seal around the at least one port, the upper and lower seals configured to contact the first casing. In this way, the wash fluid can be directed into the perforations.

Preferably, the BHA includes a casing cutter. In this way, the BHA may be used to make the initial cut at the CCTD and/or further cuts if the first casing remains stuck after even after extensive washing.

The BHA may include at least one perforating tool to perforate the first casing;

The BHA may include a packer, the packer may be combined with the washing tool.

The BHA may include a scraper or mill to scrape the surface of the first casing and clean up after perforating.

The at least one perforating tool may be a perforating gun which may be operated by explosive charge. The BHA may include a release mechanism so that the perforation gun can be dropped in the well after perforation. Alternatively the at least one perforating tool may be a punch tool which may be operated hydromechanically.

The BHA may include a logging tool to provide a log of the annulus behind the first casing so that the free casing depth can be determined prior to perforating.

The BHA may include a vibration tool to provide cause vibrational movement to assist in dislodging debris from the first casing.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings and elements of the embodiments discussed below may be employed separately or in any suitable combination to produce the desired results. Additionally, while relative terms such as 'upper' and 'lower' are used and the drawings indicate vertical wells, the invention finds application in deviated wells.

BRIEF DESCRIPTION OF DRAWINGS

Embodiments of the present invention will now be described, by way of example only, with reference to the accompanying drawings of which.

DETAILED DESCRIPTION OF THE INVENTION

Figures 1A, 1B, 1C, 1D, 1E:
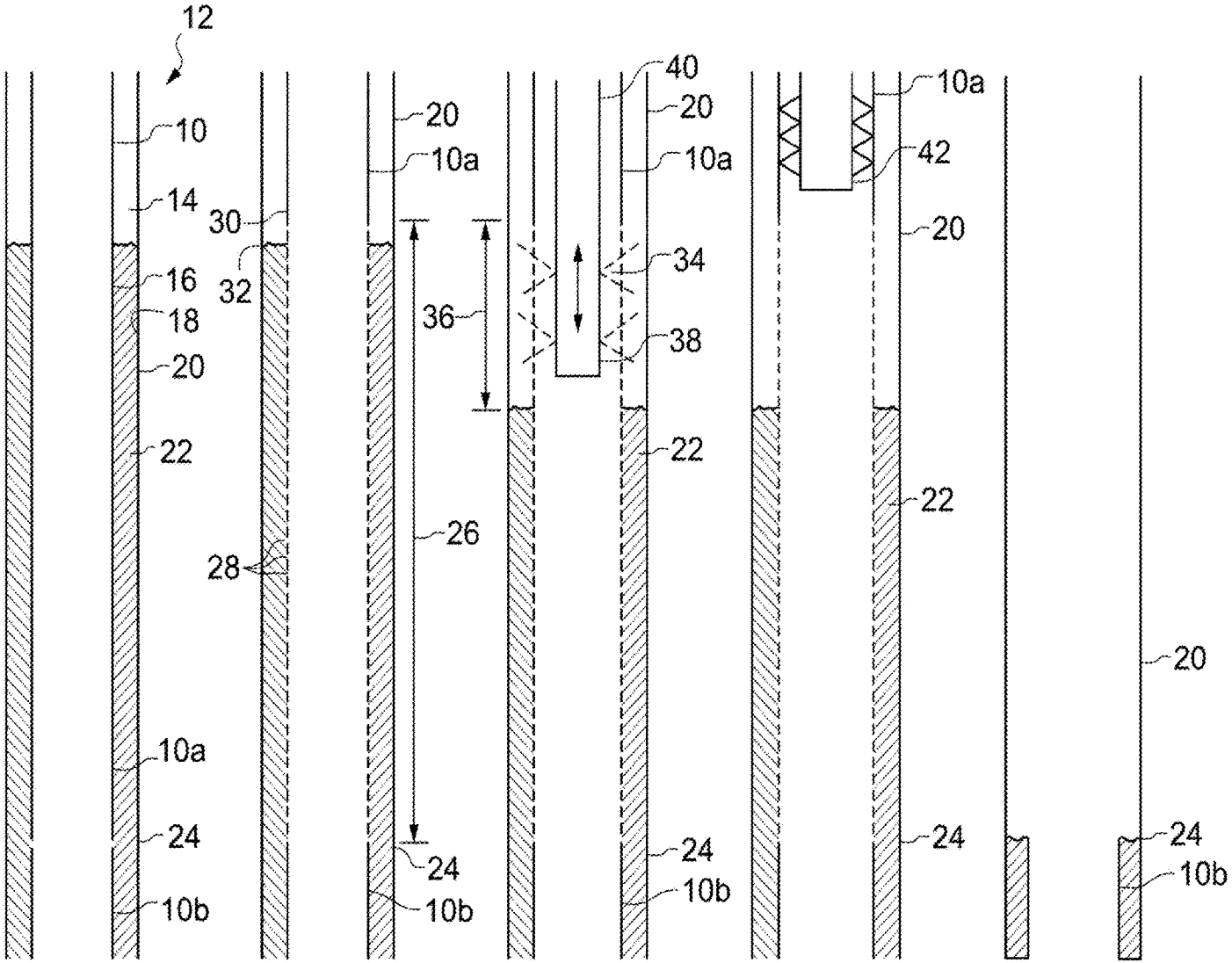
FIGS. 1(*a*) to 1(*e*) illustrate steps in a method of removing casing from a well, according to an embodiment of the present invention.

Reference is initially made to FIGS. 1(*a*)-(*e*) of the drawings which illustrate a method of removing casing 10 from a well 12, in which an annulus 14 between the outside 16 of the casing 10 and the inside 18 of a surrounding downhole body, typically outer casing 20 but may be the borehole wall, is at least partially filled by debris 22, according to an embodiment of the present invention.

In FIG. 1(*a*), the well 12 is shown with an outer casing 20 around the casing 10 and debris 22 located in the annulus 14 therebetween. A casing cutting target depth (CCTD) 24 has been determined, noting that debris 22 is located higher than this point in the annulus 14. A step in the method is to cut the casing 10 at the CCTD 24. Casing cutters are known to those skilled in the art. This is shown in FIG. 1(*a*) but could occur at a later stage in the method. Casing 10 then comprises a cut section of casing 10*a* and remaining casing 10*b*. An attempt to pull the cut section of casing 10*a* can be made but it is unlikely to succeed due to the debris 22.

In FIG. 1(*b*), the cut section of casing 10*a* is perforated over a perforation length 26. The perforations 28, preferably extend down to the CCTD 24, but they may be located from a short distance above or pass over the CCTD 24. An upper end 30 of the perforations 28 preferably lies at or around the actual free casing depth (AFCD) 32. Techniques such as those described in WO2020/256563, which is incorporated herein by reference, can be used to identify the AFCD 32. The perforations 28 can be made by perforating guns, punches and the like tools which are known to those in the industry.

Starting at the upper end 30 of the perforations 28, a fluid 34 is introduced from a wash tool 38 into the annulus 14 to clear debris 22. This is illustrated in FIG. 1(*c*). A first length 36 of the perforations is washed so that fluid 34 flows through the perforations 28 and up the annulus 14 dislodging debris 22 and circulating it out of the well 12. The first length 36 is shorter than the perforation length 28. The wash tool 38 can be lowered in a continuous motion or discretely, stage by stage along the first length. Optionally, the wash tool 38 can be moved up the well 12. It will be realised that the wash tool 38 may include swab cups at one or both ends to direct fluid 34 into the annulus 14 and/or include jets to direct fluid 34 into the annulus 14 and/or be combined with a packer which seals between the string 40 and the casing 10*a* above the wash tool 38.

Once a portion of debris 22 is cleared from the first length 36, a spear 42 is engaged to grip the casing 10*a* and the cut section of casing 10*a* is pulled. This is shown in FIG. 1(*d*). If the cut section of casing 10*a* is free, then the cut section of casing 10*a* is recovered. It is noted that the entire cut section of casing 10*a* is removed to the CCTD 24, leaving only the remaining casing 10*b*, as shown in FIG. 1(*e*). It will be appreciated that this method will take a significantly shorter period of time than the prior art in which the entire perforation length 18 requires to be cleaned.

In the event that the cut section of casing 10*a* remains stuck and cannot be pulled, a second length of the perforations 28 can be washed using the wash tool 38. The second length is shorter than the perforation length 26 and extends the length of cleared debris 22 in the annulus. The spear 42 is engaged again and the cut section of casing 10*a* pulled. If the casing 10*a* is free it is recovered to surface. These steps illustrated in FIGS. 1(*c*) and 1(*d*) can be repeated for increasing lengths of washed perforations 28 until the cut section of casing 10*a* is free and can be pulled from the well 12. The first and second lengths may be sequentially located along the perforation length. Alternatively, the first and second lengths overlap by at least a portion. Preferably, the first, second and subsequent lengths are sequentially located along the perforation length. In this way, the perforation length may entirely be washed. Alternatively, one or more of the first, second and subsequent lengths overlap. This provides a more intense wash over the same length of perforations.

By pulling the section of casing periodically during washing, the section of casing can be pulled from the well as soon as it is free. This saves significant time in reducing the amount of washing required.

Figure 2:
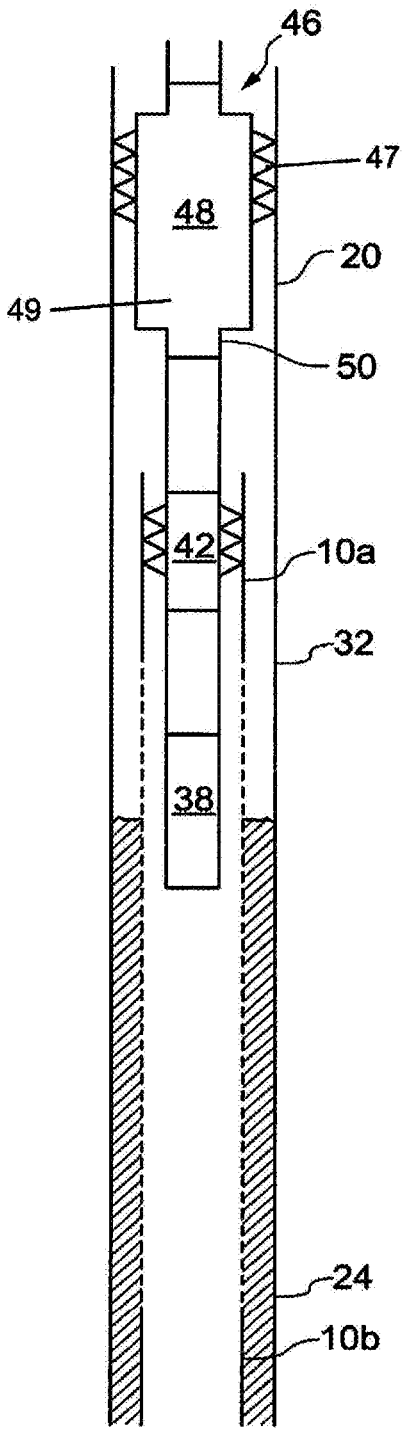
FIG. 2 is a schematic illustration of a bottom hole assembly (BHA) according to an embodiment of the present invention.

Referring to FIG. 2, there is illustrated a bottom hole assembly (BHA) 46 which can be used in the method, according to an embodiment of the present invention. BHA 46 includes the wash tool 38, the spear 42 and a downhole power tool (DHPT) 48. As illustrated, the DHPT 48 has an anchor mechanism 47 configured to grip the outer casing 20 above the inner casing 10 and is anchored thereto. The DHPT 48 includes pistons 49 which can act on a lower mandrel 50 and by application of pressure, pull high forces on the stuck casing 10. This procedure is known and is described in GB2473527B to Ardyne Holdings Ltd, which is incorporated herein by reference. In this way, the DHPT 48 is able to apply higher forces than the rig alone is able to apply. In the method of the present invention, the step of pulling the cut section of casing 10*a*, can include pulling using the DHPT 48. Accordingly, a reduced amount of washing will be required to remove the cut section of casing 10*a*.

Figure 3:
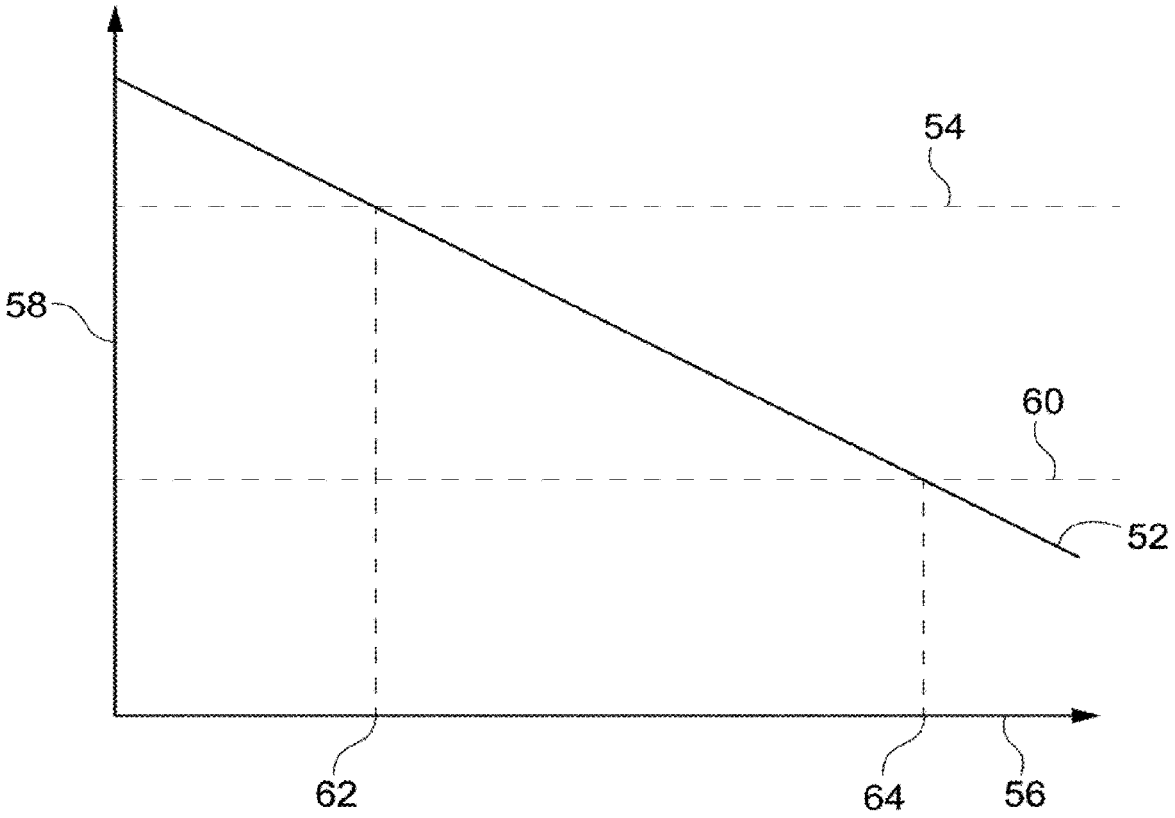
FIG. 3 is an illustrative graph of force to pull against wash time.

By incorporating a DHPT 48 in the BHA 46, the system has advantages over using just a spear in that the DHPT 48 will always be able to pull the casing in less time than the spear. With the DHPT 48 in the same string then one can periodically apply DHPT 48 pulling loads at intervals during the washing. As soon as the release load 52 falls below the max DHPT load 54 the casing 10*a* would come free. Referring to FIG. 3 there is illustrated a graph of washing time 56 against force 58, being the force required to pull the casing. The maximum loads 54, 60 for the DHPT and the spear are indicated, respectively. The release load 52 is a falling line with increased washing time, which crosses the maximum load 54 for the DHPT in a shorter washing time 62, than for the spear washing time 64. This illustrates the benefit in reduced time in utilising the DHPT 48.

Figure 4:
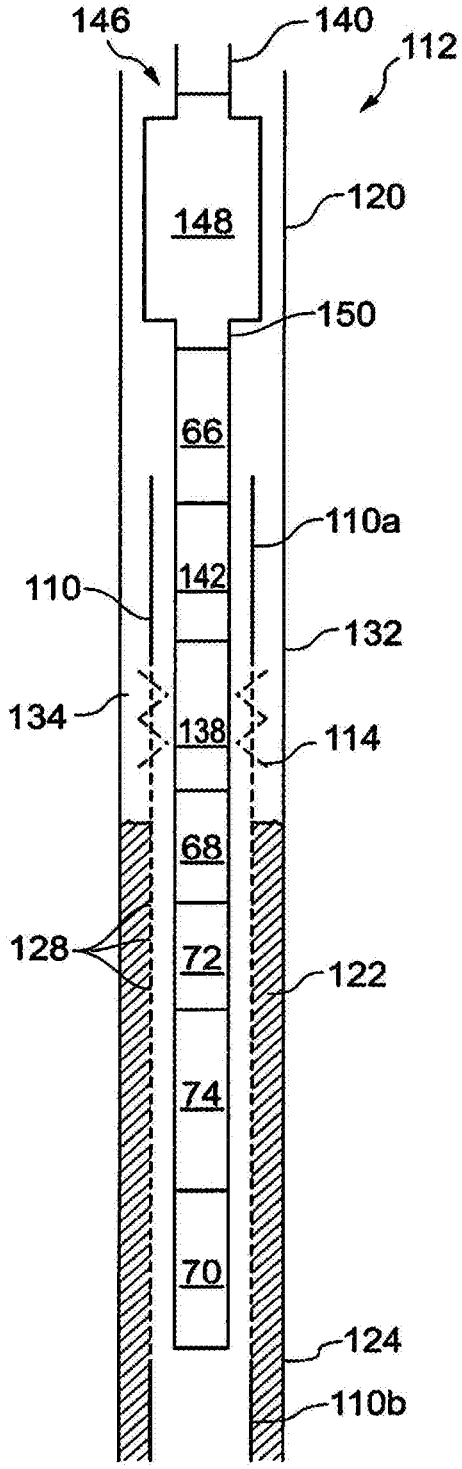
FIG. 4 is a schematic illustration of a bottom hole assembly (BHA) according to a further embodiment of the present invention.

Reference is now given to FIG. 4 of the drawings, which illustrates a BHA 146, according to an embodiment of the present invention. Like parts to those of the BHA 46 of FIG. 2, have been given the same reference numeral with the addition of 100 to aid clarity. BHA 146 is mounted on a drill pipe string 140 with a through bore and includes: a DHPT 148 to engage outer casing 120; collars 66 to extend the mandrel 150 into casing 10; a spear 142; a wash tool 138 which incorporates a packer; an optional casing cutter 68; an optional logging tool 72; an optional vibration tool 74; and a perforating tool 70, being perforating guns.

In use, as described with reference to FIGS. 1(*a*) to 1(*e*), the BHA 146 is run into the well 112 and the perforating guns 70 are positioned at an appropriate depth adjacent the casing section 10 packed with debris 122. The depth may be the FCD 132 determined from use of a logging tool 72 as is known in the art. The casing 110 is perforated, after which the perforating guns 70 may be dropped into the wellbore as per known procedure. Alternatively other perforating tools such as hydromechanical punch tools may be used which are not required to be dropped from the BHA 146. The packer is then set adjacent perforations towards the upper end of the packed casing section. Fluid is then circulated down the drill string 140 and out of the wash tool 138. The fluid flows through the perforations 128 and up the annulus 14 dislodging debris 122 and circulating it out of the wellbore. The BHA 146 is then lowered, the packer sequentially exposes new perforations, thereby circulating out debris from successively lower portions of the casing. This is continued until a desired portion has been washed. The BHA 146 may be lowered in a continuous motion or discretely, stage by stage.

This process continues until, at a time or at a position selected by the operator, washing is stopped and the spear 142 engaged in the casing 10. Attempts can now be made to pull the partly cleaned casing 110*a* from the well. The DHPT 148 is set and operated. A valve can be located in the mandrel 150 to close and allow pressure to build up in the DHPT 148 to operate it. As has been explained previously the DHPT 148 can apply higher forces than the rig alone and is therefore more likely to be able to recover the casing piece 110*a*. If recovery is successful, the casing piece 10*a* is removed from the wellbore 112. It may be seen that in this circumstance, the time required to remove the casing piece is shorter than by conventional methods in which the entire section of casing has to be washed clean before the pulling operation is commenced.

If the DHPT 148 cannot recover the casing piece 110*a* then the washing process is repeated for a further section of casing and attempts to pull tried again, until the casing piece 110*a* is recovered. By application of this procedure, it may be seen that rig time may be reduced due to the inclusion of the DHPT 148 along with a stepwise washing and pulling attempt sequence.

In a further embodiment, a cutter 68 is included at the lower end of the BHA 146. The cutter 68 can be used to cut the casing 10 at the casing cutting target depth (CCTD) 124 giving the desired length of cut section of casing 110*a* to be removed from the well. The cutter 68 can be operated at any stage in the method before the section of casing 110*a* is pulled. If the cut is made first and a packer is present on the string above the cutter, a circulation test can be performed as the cut is made. This monitoring for return of fluid up the annulus can provide information on the debris 122 distribution in the annulus 114. Additionally, if, after washing and attempted pulls, it is determined that further washing is unlikely to lower the pulling force to an achievable level. The casing piece 10*a* can be cut without removing the BHA 146 from the wellbore. Attempts to pull can then be resumed as described previously in the prior art whereby shorter sections of casing are removed. This embodiment provides apparatus which can perform the method in a single trip in the well.

In a still further embodiment, a vibration tool 74 is incorporated in the BHA 146. Such tools are known to create vibrations in circulating fluids, examples being described in GB2562090 and GB2562089 incorporated herein by reference, and/or vibrate the casing, an example being the dynamic amplification tool described in GB2583015 incorporated herein by reference. In the method, the vibration tool 74 can operate during washing to create pulses in the wash fluid 134 which can assist in dislodging the debris 122 in the annulus 14 and vibrate the casing 10 to additionally assist in dislodging the debris 122. Additionally, by operating the vibration tool 74 with the DHPT 148 in the BHA 146, vibration of the casing 110*a* assists in its release, and/or vibration of the fluid operating the DHPT 146 can cause additional vibration to the casing 10*a* giving further advantages in being able to pull casing in less time than with the spear alone.

Figures 5A, 5B, 5C, 5D, 5E:
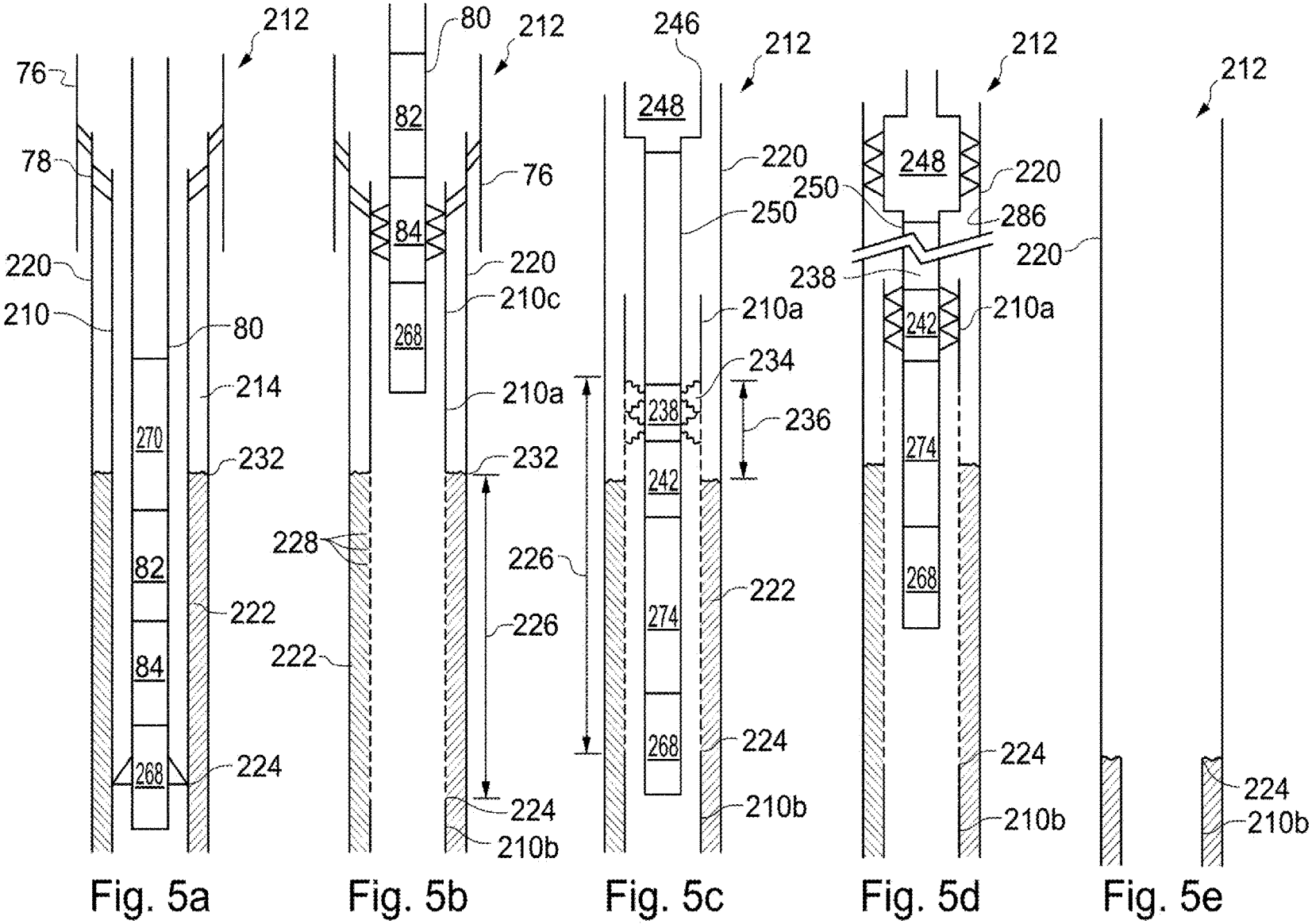
FIGS. 5(*a*) to 5(*e*) illustrate steps in a method of removing casing from a well, according to a further embodiment of the present invention.

Referring now to FIGS. 5(*a*) to 5(*e*), there is illustrated apparatus and method for removing a casing from a well according to a further embodiment of the present invention, like parts to those of earlier figures are given the same reference numeral with the addition of 200 to aid clarity. FIG. 5(*a*) illustrates a well with first casing 76 extending down to a depth whereafter a smaller diameter casing 220 extends further down to a casing hanger and seal 78 near the lower end casing 220. The casing 210 to be removed is below the hanger and seal 78 but can be a liner extending to the surface. The CCTD 224 is determined.

A first BHA 80 is run in the well 212. BHA 80 includes: a perforating tool 270, being a punch tool combined with a wash/clean tool; a packer 82 being a tension set packer; an anchor 84 which can be used as a spear; and a casing cutter 268. The first BHA 80 is run in the inner casing 210 to position the cutter 268 at CCTD 224. If desired, the anchor 84 can be set during cutting to steady the cutter 268, the anchor 84 including a bearing or swivel so that the string 240 can be rotated from surface to rotate the cutter 268. Alternatively a downhole motor could be used to rotate the cutter 268. Once cutting is complete, the packer 82 can be set and a circulation test performed in which fluid is circulated through the cut and it is determined if any returns up the annulus 214 to surface. In the preferred embodiment the packer 82 is a tension set packer. If so, the anchor 84 can be repositioned towards the upper end of the casing 210 and a pull attempted from the rig. Assuming the casing 210 is stuck, the punch 270 tool is used initially to identify the top of solids or FCD 232. This is performed by known techniques such as those described in WO2020/256563, which is incorporated herein by reference. This provides an upper end 230 for the perforations 228 and the punch tool 270 then punches perforations 228 along the perforation length 226 between the FCD 232 and the CCTD 224. The punch tool 270 which includes a wash/clean function, which could be a separate tool, washes the annulus during punching. The cutter 268 is then moved to a position above the FCD 232 and the casing 210 is cut to form an upper casing section 210*c*, a cut casing section 210*a* and a remaining casing section 210*b*. This is as shown in FIG. 5(*b*). The anchor 84 is moved to the top of the casing section 210*c* and the upper casing section 210*c* is pulled out of the well 12 to expose the inner surface 86 of the outer casing 220 above the cut section of casing 210*a*. This may be considered as long string recovery.

A second BHA 246, according to an embodiment of the present invention, is run into the well 212, see FIG. 5(*c*). Second BHA 246 includes: a DHPT 248; collars 266; a wash tool 238; an in-line spear 242; a vibration tool 274; and a casing cutter 268. The DHPT 248 remains above the cut section of casing 210*a*, while the other tools on the mandrel 250 are run into the casing section 210*a*. As described with reference to FIGS. 1(*a*) to 1(*e*) and FIG. 2, the wash tool 238 washes a first length 236 being a portion of the perforation length 226 with fluid 234 pumped from surface down the through bore of the drill pipe string on which the BHA 246 is run. It is noted that fluid travelling through the bore of the BHA 246 will activate the vibration tool 274.

Vibration tool 274 is a dynamic amplification tool with a flow modifier as described in GB2583015, incorporated herein by reference. The flow modifier produces cyclic variations in fluid pressure through the assembly at a first frequency and the BHA 246 is configured to have a natural or resonant frequency when vibrated to be near or at the first frequency. The dynamic amplification tool induces vibration in the bottom hole assembly while ensuring the dynamic amplification factor of the system is greater than one so as to transmit maximum vibration to the casing 210*a* at the spear 242, when engaged.

During washing, the flow modifier induces pulses on the circulating wash fluid which assist in dislodging the debris 222 in the annulus 214 and carrying up the annulus 214 to surface. The wash tool 238 jets the pulsing wash fluid 234 into the perforations 228.

The spear 242 is attached to the casing section 210*a* at an upper end and an attempt to pull the cut section of casing 210*a* is made. Assuming this isn't successful, the DHPT 248 is set against the inner surface 286 of the outer casing 220 using anchors to grip the surface 286. A valve in the mandrel string 250 is closed and fluid pumped from surface acts against pistons in the DHPT 248 causing it to raise the mandrel 250 and with a combined force to jack the casing 210*a*. See FIG. 5(*d*). The vibration tool 274 can be operated to resonate the BHA 246 and the vibration transmits to the casing section 210*a* via the spear 242. This aids recovery. If the release load is less than the DHPT max load the casing section 210*a* will be freed and can be raised. Releasing the DHPT from the casing 220 allows the string 140 and BHA 246 to be raised to surface with the recovered cut section of casing 210*a*, see FIG. 5(*e*).

If the DHPT 248 cannot move the cut section of casing 210*a*, the DHPT 246 and spear 242 are released. The wash tool 238 is then operated to wash a second length as described hereinbefore. The first and second lengths may be the distance between joints in the casing. The steps in the last paragraph are repeated, and the washing and pulling process is repeated along the perforation length 226 until the cut casing section 210*a* is successfully pulled and can then be retrieved to surface.

If having washed the entire perforation length 226 and the cut section of casing 210*a* will not move, most likely because one or more fluid channels have formed in the debris 222, providing pathways which allow fluid to pass between perforations in the annulus while not removing the debris 222 within the annulus, the cutter 268 can be deployed. The cutter will be positioned higher up the perforated length 226 towards the FCD 232. The casing section 210*a* is then cut to provide a shorter length of cut casing which the BHA 246 using the DHPT 248 can now pull. Subsequent sections can be cut and pulled until the entire cut section of casing 210*a* is removed from the well 212. While in most cases the cutter 268 will not be used, it is located on the BHA 246 for redundancy so that a further trip into the well is not required should further cutting be needed.

The method can therefore be completed in two trips.

Those skilled in the art will recognise that any of the tools may be combined, be positioned on a string in a suitable order for the operating sequence, and any number trips into the well can be made depending on the operators' choice. Further tools such as mills for removing burrs formed by perforating, scrapers and brushes for cleaning the inside surface of the casings, logging tools for determining the AFCD, taper mills for clearing the casing bores, and a bridge plug to be set inside the remaining section of casing can be used.

A principal advantage of the present invention is that it provides a method of removing casing from a well which takes less time in washing so that the casing can be pulled earlier and hence provides a saving on rig time compared to the prior art.

A further advantage of at least one embodiment of the present invention is that it provides a method and apparatus for removing casing from a well which uses a downhole pulling tool to exert a greater force than that available from a rig so that the casing can be pulled after a shorter washing time compared to the prior art.

The invention claimed is:

1. A bottom hole assembly (BHA) for recovering a first casing located through a second casing in a well, the second casing having a greater diameter than the first casing, the BHA being mountable on a tool string having a throughbore, the BHA comprising:

a wash tool having at least one port arranged to eject fluid from the throughbore through perforations in the first casing;

a casing spear configured to grip the first casing; and a downhole power tool having an anchor mechanism configured to grip the second casing and a hydraulic driven piston to exert a force on the casing spear so as to pull the first casing.

2. The bottom hole assembly according to claim 1, wherein the BHA includes a casing cutter.

3. The bottom hole assembly according to claim 1, wherein the BHA includes at least one perforating tool to perforate the first casing to form the perforations.

4. The bottom hole assembly according to claim 1, wherein the BHA includes a packer, the packer being combined with the washing tool.

5. The bottom hole assembly according to claim 3, wherein the BHA includes a logging tool to provide a log of the annulus behind the first casing so that a free casing depth can be determined prior to perforating.

6. The bottom hole assembly according to claim 1, wherein the BHA includes a vibration tool to provide cause vibrational movement to assist in dislodging debris from the first casing.

7. A bottom hole assembly (BHA) for recovering a first casing located through a second casing in a well, the second casing having a greater diameter than the first casing, the BHA being mounted on a tool string having a through bore, the BHA comprising:

a wash tool having at least one port arranged to eject fluid from the throughbore towards the first casing;

a casing spear configured to grip the first casing;

a downhole power tool having an anchor mechanism configured to grip the second casing and a hydraulic driven piston to exert a force on other components of the BHA; and a logging tool to provide a log of the annulus behind the first casing so that a free casing depth can be determined prior to perforating.

* * * * *